United States Patent [19]

Hines

[11] Patent Number: 4,723,808

[45] Date of Patent: Feb. 9, 1988

[54] STRETCHER FOOT PEDAL MECHANICAL LINKAGE SYSTEM

[75] Inventor: C. Haywood Hines, Caruthersville, Mo.

[73] Assignee: Colson Equipment Inc., Caruthersville, Mo.

[21] Appl. No.: 626,689

[22] Filed: Jul. 2, 1984

[51] Int. Cl.[4] ..... A61G 1/102

[52] U.S. Cl. ..... 296/20; 74/480 R; 74/512; 5/62; 5/63

[58] Field of Search ..... 296/20; 5/63-65, 5/62; 74/480 R, 512

[56] References Cited

U.S. PATENT DOCUMENTS

| | | | |
|---|---|---|---|
| 1,858,122 | 5/1932 | Thatcher | 74/480 R |
| 2,112,019 | 3/1938 | Gyger | 74/512 |
| 2,593,643 | 4/1952 | Woolf | 74/480 R |
| 3,243,825 | 4/1966 | Tabbert | 5/63 |
| 3,304,116 | 2/1967 | Stryker | 296/20 |
| 3,739,406 | 6/1973 | Koetter | 5/62 X |
| 3,820,176 | 6/1974 | Feiertag | 5/63 |
| 3,820,176 | 6/1974 | Feiertag | 5/63 |
| 3,820,838 | 6/1974 | Limpach | 296/20 |
| 4,164,355 | 8/1979 | Eaton et al. | 296/20 |
| 4,175,783 | 11/1979 | Pioth | 296/20 |
| 4,231,124 | 11/1980 | Croxton | 5/63 |
| 4,489,449 | 12/1984 | Failor et al. | 5/63 |

FOREIGN PATENT DOCUMENTS

| | | | |
|---|---|---|---|
| 1552596 | 9/1979 | United Kingdom | 5/63 |
| 2068301 | 8/1981 | United Kingdom | 5/63 |

*Primary Examiner*—Dennis H. Pedder

*Attorney, Agent, or Firm*—Neuman, Williams, Anderson & Olson

[57] ABSTRACT

A foot pedal mechanical linkage system is provided in a hydraulic stretcher used for transporting patients. Two hydraulic jacks are mounted on the stretcher's carriage at opposite ends of the stretcher, and they vertically adjust the stretcher's litter on which a patient rests. A first foot pedal assembly at one end of the stretcher and a second foot pedal assembly at the other end activate the hydraulic jacks. A linkage assembly connects the first and second foot pedal assemblies. An operator of the stretcher can raise or lower either end of the stretcher separately or together from either end of the stretcher using the foot pedal and linkage assemblies.

2 Claims, 6 Drawing Figures

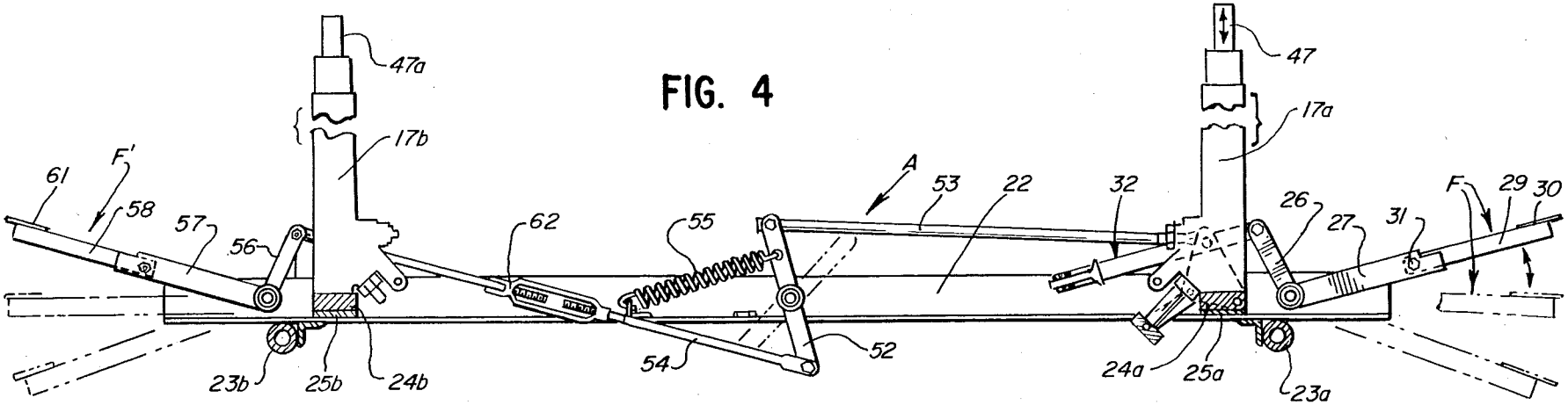
FIG. 4
FIG. 3
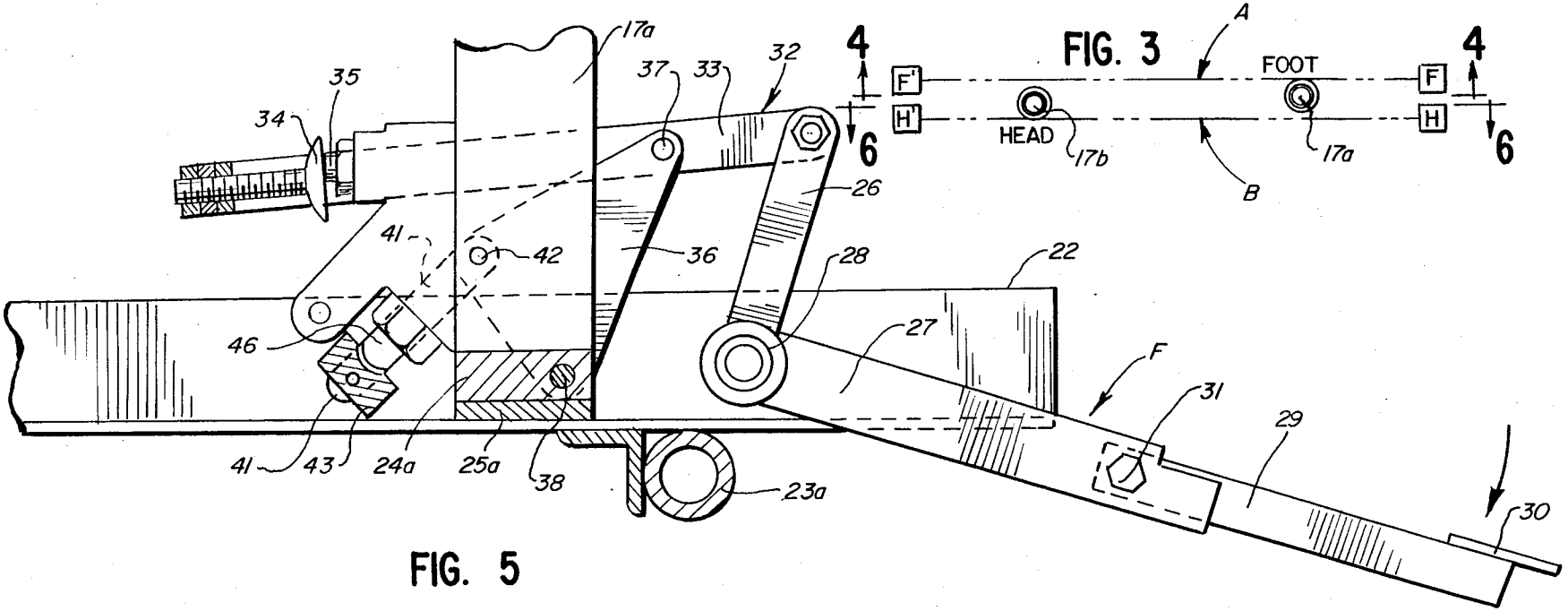
FIG. 5

STRETCHER FOOT PEDAL MECHANICAL LINKAGE SYSTEM

BACKGROUND OF THE INVENTION

1. Field of the Invention

The present invention relates to a foot pedal mechanical linkage system for a hydraulic stretcher, and more particularly to a foot pedal mechanical linkage system which allows the operator to raise and lower either end of the stretcher litter from either end of the stretcher.

2. Description of the Prior Art

Hydraulic stretchers generally comprise a frame or carriage that rides on a set of casters, a litter on which a patient rests, a hydraulic lifting system which raises and lowers the litter and a control system. The hydraulic stretchers of the prior art require the operator to use a foot pedal to activate hydraulic jacks which elevate the litter and a separate releasing device to lower it. The separate releasing device on some prior art stretchers is another foot pedal. Thus, it is common procedure for the operator to move his or her foot back and forth between the lifting pedal and the releasing pedal, pressing them until the litter reaches the desired elevation. Having separate lifting and releasing pedals, thus, complicates the operation of the stretcher.

On other prior art hydraulic stretchers the separate actuating device is a hand lever. To operate these stretchers and place the litter at the desired elevation, the operator must coordinate the use of both hands and feet. Since the operator has to use his or her hands to operate the stretcher, he or she cannot adequately attend to the patient on the stretcher.

Some prior art stretchers use hydraulic or pneumatic control devices for raising and lowering the stretcher litter. These devices include complicated mechanisms with many hydraulic or pneumatic lines and fittings that make the devices susceptible to breakdowns and malfunctions. In addition, these devices require that the operator use his or her hands to operate the stretcher, preventing the operator from adequately attending to the patient on the stretcher.

The foot pedal linkage system of the present invention avoids the problems of the prior art hydraulic stretchers. It is a simple, reliable mechanism without a multiplicity of parts which insures reliable and simplified operation of the hydraulic stretcher.

OBJECTS OF THE INVENTION

It is an object of this invention to provide a foot pedal linkage mechanism for a hydraulic stretcher.

It is another object of the present invention to provide a reliable and simplified foot pedal linkage mechanism for hydraulic stretchers which allows the operator of the stretcher to control the raising and lowering of the stretcher's litter from either end of the stretcher.

It is another object of this invention to provide a foot pedal linkage system for hydraulic stretchers that uses the same foot pedals to raise and to lower the stretcher's litter.

It is still another object of this invention to provide a foot pedal linkage system that is simple in design and reliable and effective in use.

Other objects, advantages and features of the present invention will become apparent upon reading the following detailed description and appended claims, and upon reference to the accompanying drawings.

SUMMARY OF THE INVENTION

In accordance with the preferred embodiment of the invention, the applicant provides a mechanical foot pedal linkage system for a hydraulic stretcher used to transport patients. The foot pedal linkage system activates two hydraulic jacks disposed at opposite ends of the stretcher between the stretchers carriage and the litter on which the patient rests.

The system comprises a first foot pedal assembly pivotally mounted to the first end of the stretcher. The first foot pedal assembly comprises a first and second foot pedal. The first foot pedal is adapted to activate the hydraulic jack at that end. The second foot pedal is adapted to operate the hydraulic jack at the opposite end of the stretcher.

The system also includes a second foot pedal assembly pivotally mounted to the second end of the stretcher. The second foot pedal assembly comprises a first and second pedal. The first pedal of the second assembly is adapted to control the hydraulic jack adjacent to the second assembly. The second pedal of the second assembly is adapted to operate the hydraulic jack at the opposite end of the stretcher. The second foot pedal of the first assembly is connected to the first foot pedal of the second assembly through a mechanical linkage. The second foot pedal of the second assembly is connected to the first foot pedal of the first assembly through a second mechanical linkage.

In activating a hydraulic jack, the operator or attendant depresses one of the two pedals associated with the jack until the pedal engages a plunger of the jack, which raises the piston of the jack a predetermined increment, correspondingly raising the litter. By releasing and pressing the pedal again, the operator can raise the piston of the jack another increment. When the operator pumps or strokes the pedal in this manner, the piston of the jack continues to rise in predetermined increments. By depressing the pedal all the way down to the bottom of its stroke and holding it there, the operator activates a release mechanism which lowers the piston of the jack.

The foot pedal linkage system allows the operator of the stretcher to activate either of the two hydraulic jacks from either end of the stretcher and, therefore, to raise and lower either end of the stretcher's litter from either end of the stretcher. The operator can raise either end of the stretcher's litter separately by pressing the appropriate pedal of the two pedals provided in each pedal assembly at each end of the stretcher. The operator can also raise both ends of the stretcher's litter at the same time by pressing both pedals in either pedal assembly provided at each end of the stretcher. In addition, the operator can lower either end of the litter separately by pressing the appropriate pedal in either pedal assembly and holding it at the bottom of its stroke. Finally, the operator can lower both ends of the litter by pressing both pedals of either pedal assembly and holding them at the bottom of their stroke.

Thus, the foot pedal linkage system of the present invention provides a mechanism that allows the operator of a hydraulic stretcher to:

(a) raise either end of the stretcher's litter by pressing one pedal of the pair of pedals provided at each end of the stretcher;

(b) raise both ends of the stretcher's litter at the same time by pressing botn pedals at either end of the stretcher;

(c) lower either end of the stretcher's litter by merely holding the appropriate pedal at either end of the stretcher at the bottom of the pedal's stroke.

(d) lower both ends of the litter at the same time by holding both pedals at either end of stretcher at the bottom of their stroke.

It is desirable to have a stretcher with this foot pedal linkage system because such a stretcher is easy to operate and it frees the hands of the operator for attending the patient on the stretcher.

BRIEF DESCRIPTION OF THE DRAWINGS

For a more complete understanding of this invention one should now refer to the embodiment illustrated in greater detail in the accompanying drawings and described below by way of an example of the invention. In the drawings:

FIG. 3 is a schematic view of the foot pedal linkage system of this invention.

FIG. 4 is a sectional view taken along line 4—4 in FIG. 3 and showing the foot pedal linkage mechanism that activates the hydraulic jack at the foot of the stretcher.

FIG. 5 is an enlarged view of the hydraulic jack and pedal arrangement at the foot of the stretcher.

While the invention will be described in connection with a preferred embodiment, it will be understood that it is not limited to this embodiment.

DETAILED DESCRIPTION OF THE DRAWINGS AND A PREFERRED EMBODIMENT

Figure 1:
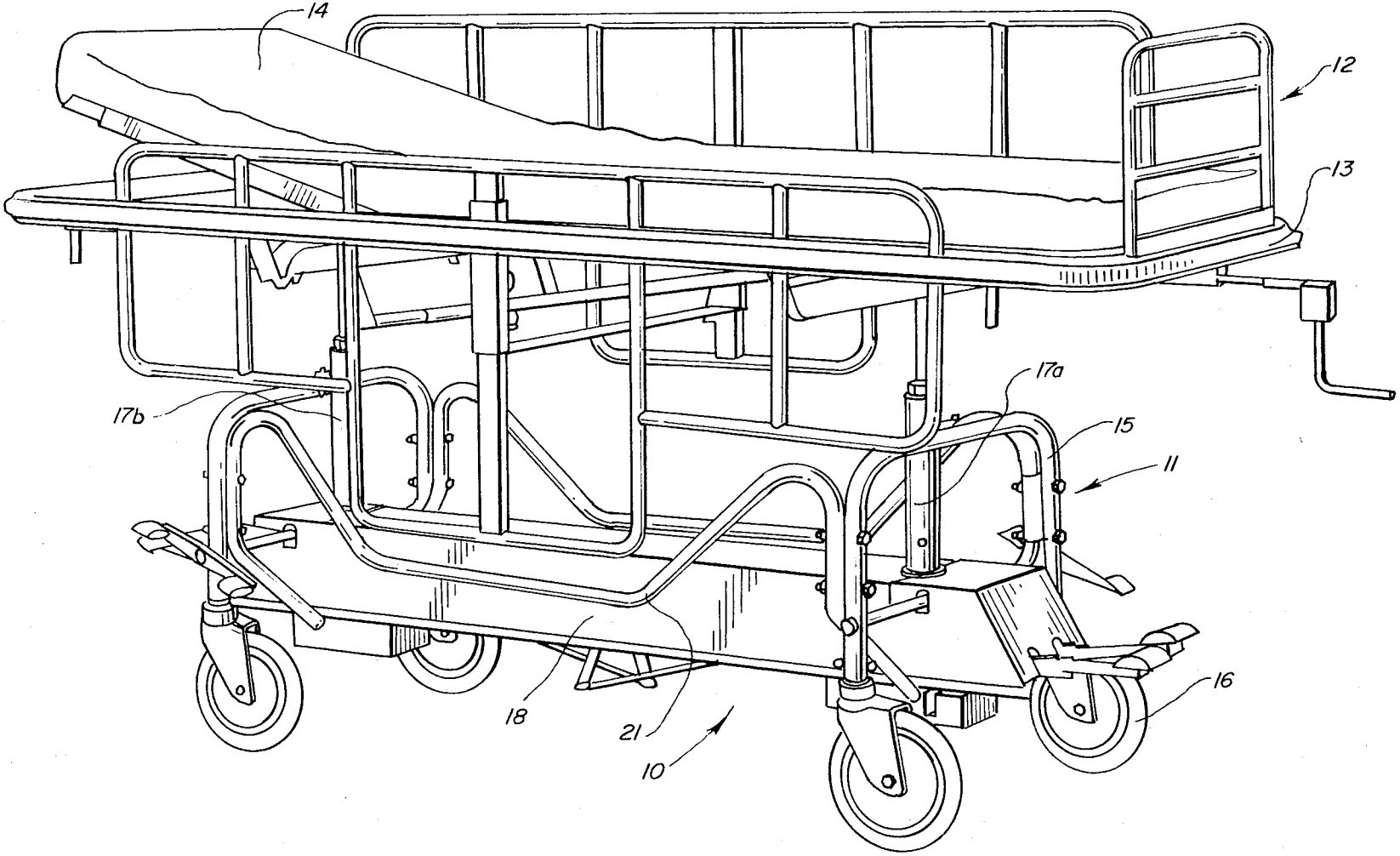
FIG. 1 is a perspective view of the stretcher employing a preferred embodiment of a foot pedal linkage system of this invention.

Turning now to the drawings, FIG. 1 shows a stretcher with a foot pedal linkage system generally at 10. The stretcher comprises a carriage 11 and a litter 12 which includes a planar frame unit 13 and a mattress or pad 14 overlying the frame unit. The carriage 11 comprises: a chassis 15 that rides on wheels or casters 16 along a floor surface; two hydraulic jacks 17*a* and 17*b* mounted on the chassis 15, disposed at opposite ends of the carriage, suitably attached to the bottom of the frame unit 13, and adapted to support and vertically adjust the frame unit 13 of the litter 12. The foot pedal linkage system is contained in housing 18 and appropriately mounted on the carriage and adapted to effect vertical adjustment of the litter 12 by controlling hydraulic jacks 17*a* and 17*b*. U.S. Pat. No. 4,629,242 issued Dec. 16, 1986 to James E. Schrager describes the stretcher more fully. The disclosure of this pending application is incorporated herein by this reference.

Figure 2:
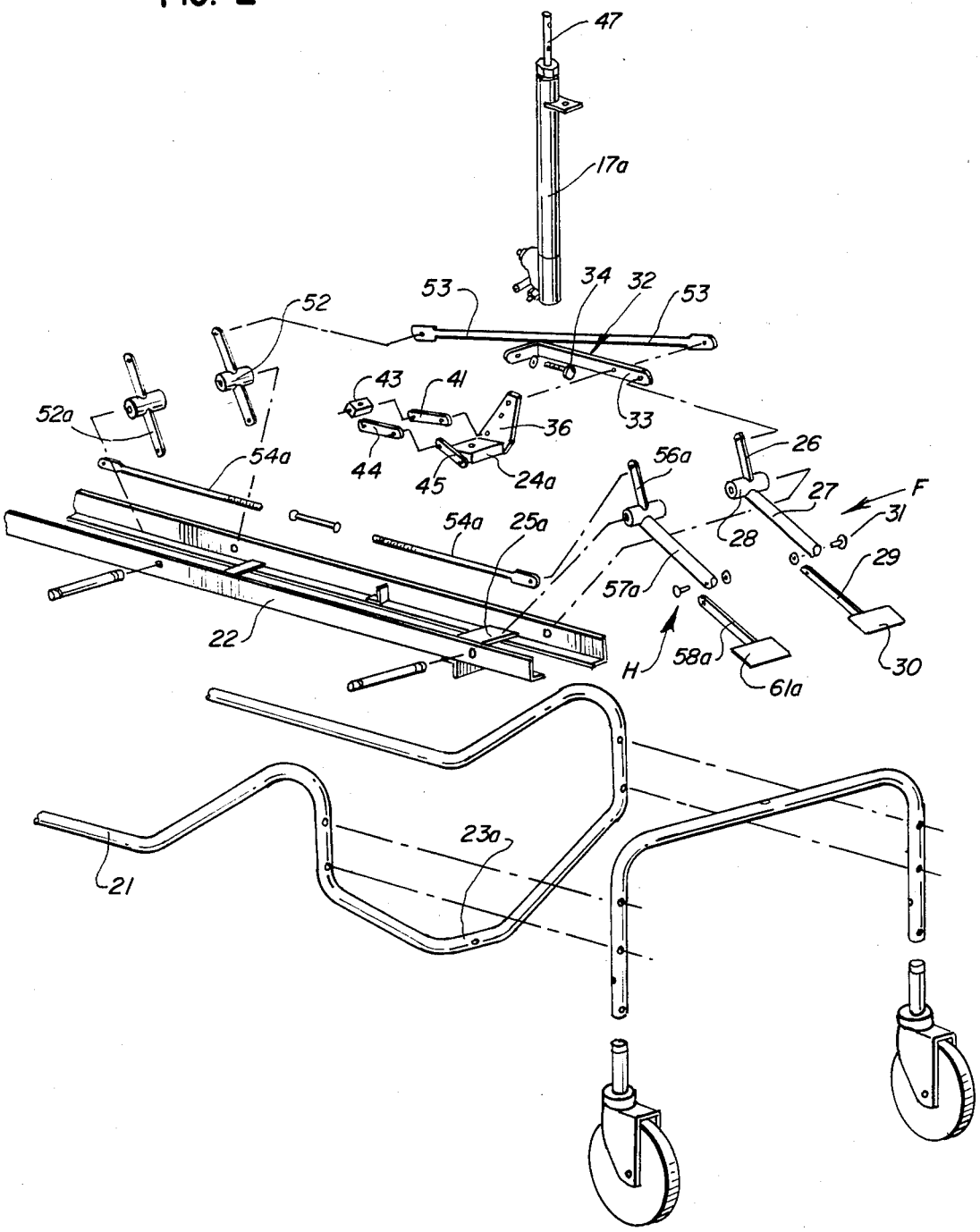
FIG. 2 is a partial exploded view of the foot pedal linkage system of the present invention.
Figure 6:
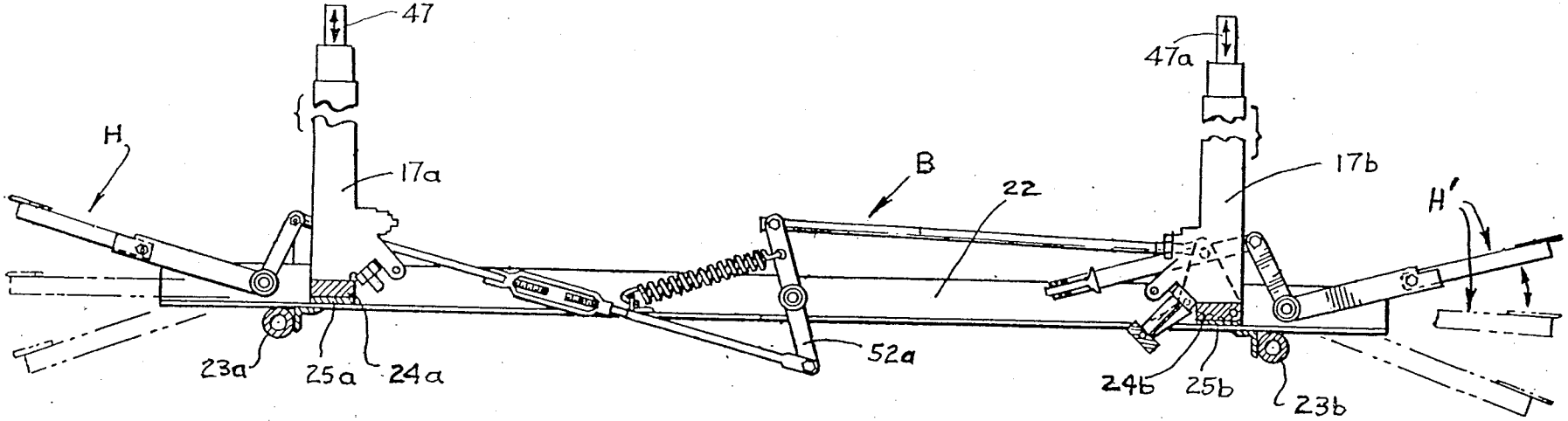
FIG. 6 is a sectional view taken along line 6—6 in FIG. 3 and showing the foot pedal linkage mechanism that activates the hydraulic jack at the head of the stretcher.

Referring now to FIGS. 1, 2 and 4 (FIG. 2 shows one-half of the foot pedal linkage system 10 since the other half consists of parallel parts similarly arranged, see discussion below), a tubular member 21 of the chassis 15 supports a horizontal frame 22 along sections 23*a* and 23*b* of the tubular member at opposite ends of the carriage 11. This frame 22, in turn, supports the two jacks 17*a* and 17*b* of the carriage 11. These jacks are self-contained, i.e., they contain all of the hydraulic fluid and they do not require the use of lines and fittings. They are commercially available units which do not require further description, and their structure does not form a part of the invention. A pad 24*a* disposed between the bottom of the jack 17*a* and a cross member 25*a* of the frame 22 mounts the jacks 17*a* to the frame 22. A pad 24*b* similarly disposed between jack 17*b* and a cross member 25*b* of the frame 22 mounts the jack 17*b* to the frame 22. A suitable attachment between the upper portion of each jack and the chassis 15 provides adequate lateral support for the jacks 17*a* and 17*b*.

The frame 22 also supports the foot pedal linkage system 10 which activates the hydraulic jacks 17*a* and 17*b* to raise and lower the litter 12. FIG. 3 show the relative location of the jacks 17*a* and 17*b*, 17*b* at the head of the stretcher 10, 17*a* at the foot, the four foot pedal assemblies, F, F′, H and H′, and the centerlines for two linkage assemblies, A for the linkage assembly which links the two pedal assemblies F and F′ that activate the jack 17*a* at the foot of the stretcher 10, and B for the linkage assembly which links the two pedal assemblies H and H′ that activate the jack 17*b* at the head of the stretcher 10.

Turning now to FIGS. 2, 4 and 5, the linkage assembly A has the foot pedal assembly F pivotally connected to it at the right and the foot pedal assembly F′ pivotally connected to it at the left. The pedal assembly F includes an arm 26 fixedly attached to a leg 27 by a pivot weldment 28. An extension 29 is pivotally mounted to the leg 27. When pressing down on the pedal's foot plate 30 the leg 27 and its extension 29 stay in a rigid, straight line alignment; but when kicking up on the extension 29, the extension pivots up and around a pivot screw 31. This is a safety feature that prevents injury to anyone standing next to the end of the stretcher opposite the end from which the operator controls the stretcher and to anyone who runs into the pedal assembly. As discussed below, when the operator depresses a pedal at one end of the stretcher, a corresponding pedal at the other end imitates the motion of the first. Thus, anyone standing at the other end of the stretcher may be injured but for the safety feature. The pedal assembly F is pivotally mounted to the frame 22 through pivot weldment 28 at the end of the frame and pivotally connected to the end of a pressure release mechanism or device 32 at the end of the arm 26 opposite the end with the pivot weldment 28.

The pressure release mechanism 32 has an L-shaped member 33 (See FIG. 2) with a bolt 34 screwed into the foot of the L and disposed so that it will activate a release 35 on the jack 17*a* to lower the litter 12 when the pedal assembly F rotates and reaches the bottom of its stroke (See FIG. 5).

Referring to FIG. 5, a triangular plate member 36 disposed between the pressure release mechanism 32 and the pad 24*a* has one of its corners pivotally attached to the member 33 of the pressure release mechanism 32 a short distance from the end of the member, as at 37, its other corner pivotally connected to the pad 24*a*, as at 38, and its third corner pivotally attached to one end of a bracket 41, as at 42. The other end of the bracket 41 has a plunger block 43 mounted to it. This bracket 41 along with brackets 44 and 45 (See FIG. 2) suspend the block 43 below a plunger 46 of the jack 17*a*. The bracket 44 has one end secured to the block 43 and the other pivotally connected to the bracket 45. The bracket 45 has one end pivotally connected to bracket 44 and the other end to the edge of pad 24 opposite the edge to which plate 36 is connected. This bracket, plate and block assembly activates the plunger 46 and, thus, the jack 17*a* to raise the litter 12.

When the operator of the stretcher 10 presses down on the pedal foot plate 30, the pedal assembly F rotates in a clockwise direction. The arm 26 of the pedal assembly F pulls the member 33 of the pressure release mechanism 32 to the right and the member 33 pulls the plate 36 along with it. Thus, the plate 36 rotates about the point 38 in a clockwise direction. In rotating, the plate 36 pulls brackets 41, 44 and 45 up along with it. These brackets, in turn, raise plunger block 43 and bring it into contact with the plunger 46. The block 43 pushes the plunger 46 into the body of the jack 17*a* and the jack's piston 47 rises a predetermined increment. By releasing and pressing down on the pedal foot plate 30 again, the operator can raise the piston 47 another increment. When the operator pumps or strokes the pedal foot plate in this manner, the piston 47 of the hydraulic jack 17*a* continues to rise in these predetermined increments. After the plunger block has activated the plunger 46 and upon further rotation of the pedal assembly F, the bolt 34 comes into contact with the release 35 at the end of the pedal assembly's stroke. By holding the pedal F in this position the bolt 34 continues to activate the release 35, lowering the jack's piston 47.

Turning now to FIG. 4, the operator of the stretcher can activate the jack 17*a* at the foot of the stretcher in the manner described above by activating the pedal assembly F' located at the opposite end of the stretcher, using the linkage assembly A. This linkage assembly A includes a propeller-type rotary member 52 pivotally mounted to the frame 22 at the midpoint of the frame. It also includes connecting rods 53 and 54 and a spring 55. The connecting rod 53 pivotally connects the top end of the rotary member 52 with the pressure release mechanism 32 at 37. The connecting rod 54 pivotally connects the bottom end of the rotary member 52 to an arm 56 of the pedal assembly F' at the head of the stretcher 10. The pedal assembly F' also includes a leg 57 fixedly attached to the arm 56, an extension 58 pivotally mounted to the leg 57 and a foot plate 61. The arm 56, the leg 57, the extension 58 and the plate 61 correspond to the arm 26, the leg 27, the extension 29 and the plate 30 of the pedal assembly F and operate in the same manner. When the pedal assembly F and F' stand free, the rotary member 52 stands slightly inclined towards the head of the stretcher 10 due to the force exerted by the spring 55 which extends between the top of the rotary member 52 and a point on the frame 22 past the midpoint of the frame towards the head of the stretcher. Upon application of downward pressure to either of the two pedal assemblies F or F', the rotary member 52 rotates in the clockwise direction and increases the tension in spring 55. Upon release of the downward pressure, the spring 55 brings the rotary member 52 to the previous position, raising both pedal assemblies to their previous position.

The connecting rod 54 may include a turnbuckle 62 which allows the adjustment of the rod's length and, thus, the vertical adjustment of the pedal assemblies F and F'.

The hydraulic jack, foot pedal and linkage arrangement for the jack 17*b* located at the head of the stretcher 10 is similar to that shown in FIG. 4 and described above with the exception that the arrangement is transposed. Thus, the pedal assembly H has the same components as the pedal assembly F'. As shown in FIG. 2, an arm 56*a*, a leg 57*a*, an extension 58*a* and a foot plate 61*a* of the pedal assembly H correspond to the members 56, 57, 58 and 61 of the pedal assembly F' and operate in the same manner. The pedal assembly H' at the head of the stretcher (See FIG. 3) has the same components as the pedal assembly F, and it functions in the same manner. The linkage assembly B is also similar to the linkage assembly A. Here, a rotary member 52*a* (See FIG. 2) stands slightly inclined towards the foot of the stretcher 10 in the free-standing position. A connecting rod 54*a*, corresponding to the rod 54 of linkage assembly A, is disposed at the foot of the stretcher 10, connecting the bottom end of the rotary member 52*a* to the pedal assembly H. A connecting rod (not shown) which corresponds to the connecting rod 53 is disposed at the head of the stretcher 10, connecting the top end of member 52*a* to the pedal assembly H'.

To operate a stretcher with the foot pedal linkage system of the present invention, the operator, while standing at the foot of the stretcher, may activate the pedal assembly F or H or both. By pressing only the foot plate 30 to activate pedal assembly F, the operator can activate the plunger 46 of the jack 17*a* located at the foot of the stretcher, raising the jack's piston 47 a predetermined increment and, thus, the foot end of the litter 12 by the same increment. By releasing and pressing down on the foot plate 30 again, the operator can raise the piston 47 another increment. When the operator pumps or strokes the pedal assembly F in this manner, the piston 47 of the hydraulic jack 17*a* continues to rise in these predetermined increments. While the operator pumps and releases the pedal assembly F at the foot of the stretcher, the pivot and linkage assembly A connecting the two pedal assemblies F and F' moves the pedal assembly F' at the head of the stretcher so that it imitates the motion of the pedal assembly F at the foot of the stretcher. If the operator presses down on the foot plate 30 of the pedal assembly F and keeps it at the bottom of its stroke, the pressure release mechanism 32 will activate the release 35 of the jack 17*a*, lowering the jack's piston 47. The piston 47 will continue lowering the foot end of the litter 12 until the operator releases the foot plate 30.

By pressing only foot plate 61*a* of the pedal assembly H at the foot of the stretcher, the operator can activate jack 17*b* located at the head of the stretcher, raising the jack's piston 47*a* a predetermined increment and, thus, the head end of the litter 12 by the same increment. The operator can activate this jack 17*b* using the pivot and linkage assembly B that connects the two pedal assemblies H and H'. The operator can raise or lower the head end of the litter 12 in the same manner described above. While the operator pumps and releases the pedal assembly H at the foot of the stretcher, the pedal assembly H' at the head of the stretcher imitates the motion of this pedal through the pivot and linkage assembly B.

Activating both pedal assemblies F and H at the foot or both pedal assemblies F' and H' at the head of the stretcher simultaneously, the operator can activate both of the hydraulic jacks 17*a* and 17*b* and, thus, raise or lower the litter 12 while maintaining the horizontal or sloped alignment of the litter 12.

While only one embodiment of the invention has been shown, it will be understood, of course, that the invention is not limited thereto since modifications may be made and other embodiments of the principles of this invention will occur to those skilled in the art to which the invention pertains, particularly upon considering the foregoing teachings. It is, therefore, contemplated by the appended claims to cover any such modifications and other embodiments as incorporate those features which constitute the essential features of this invention within the true spirit and scope of the following claims:

What is claimed is:

1. A stretcher having first and second ends and used for transporting a patient above a surface, said stretcher comprising: a first member for subtending and supportingly engaging the patient at a predetermined elevation relative to the surface; a carriage member supportingly engaging said first member and including surface engaging wheel means for moving said stretcher along said surface; a first jacking means disposed at said first end of said stretcher between said first member and said carriage member for vertically adjusting said first end of said first member relative to said carriage member and for tilting said first member; a second jacking means disposed at said second end of said stretcher between said first member and said carriage member for vertically adjusting said second end of said first member relative to said carriage member and for tilting said first member; a first foot operated activating and releasing means disposed at the first end of said stretcher for mechanically activating and releasing a selected one of said first and second jacking means while the other of said first and second jacking means is fixed relative to the first member to raise and lower one end of the first member or for mechanically activating and releasing both said jacking means simultaneously to raise and lower the ends of said first member, said first foot operated activating and releasing means including a first foot pedal for activating and releasing said first jacking means and a second foot pedal for activating and releasing said second jacking means; a second foot operated activating and releasing means disposed at the second end of said stretcher for mechanically activating and releasing a selected one of said first and second jacking means while the other of said first and second jacking means is fixed relative to the first member to raise and lower one end of the first member or for mechanically activating and releasing both said jacking means simultaneously to raise and lower said first member, said second foot operated and releasing means including a third foot pedal for activating and releasing said second jacking means and a fourth pedal for activating and releasing said first jacking means; a first mechanical linkage means connecting said first foot pedal of said first foot operated activating and releasing means and said fourth foot pedal of said second foot operated activating and releasing means with said first jack means; a second mechanical linkage means connecting said second foot pedal of said first foot operated activating and releasing means and said third foot pedal of said second foot operated activating and releasing means with said second jack means; said first mechanical linkage means including a rotary member having first and second ends and pivotally connected to said carriage member, a first connecting rod with one end pivotally connected to the first end of said rotary member and the other end pivotally connected to said fourth foot pedal, a second connecting rod with one end pivotally connected to said second end of said rotary member, an activating member pivotally connected to said carriage member, and a releasing member pivotally connected to said first foot pedal, the other end of said second connecting rod and said activating member pivotally connected to said releasing member, said activating member engaging said first jack means upon depression of said first or fourth foot pedal to activate said first jack means and raise the first end of said first member, and said releasing member engaging said first jack means upon full depression of said first or fourth foot pedal to release said first jack means and lower the first end of said first member.

2. The stretcher of claim 1, wherein said second mechanical linkage means includes a second rotary member having first and second ends and pivotally connected to said carriage member; a third connecting rod with one end pivotally connected to the first end of said second rotary member and the other end pivotally connected to said second foot pedal; a fourth connecting rod with one end pivotally connected to said second end of said second rotary member; a second activating member pivotally connected to said carriage member; and a second releasing member pivotally connected to said third foot pedal, the other end of said fourth connecting rod and said second activating member pivotally connected to said second releasing member; said second activating member engaging said second jack means upon depression of said second or third foot pedal to activate said second jack means and raise the second end of said first member, and said second releasing member engaging said second jack means upon full depression of said second or third foot pedal to release said second jack means and lower the second end of said first member.

* * * * *